US010252322B2

(12) United States Patent
Honsel

(10) Patent No.: US 10,252,322 B2
(45) Date of Patent: Apr. 9, 2019

(54) METHOD FOR CONFIGURING A MANDREL OF A RIVETING TOOL FOR BLIND RIVET ELEMENTS AND RIVETING TOOL

(71) Applicant: VVG-BEFESTIGUNGSTECHNIK GMBH & CO., Neumuenster (DE)

(72) Inventor: Michael H. Honsel, Esgrus (DE)

(73) Assignee: VVG-BEFESTIGUNGSTECHNIK GMBH & CO., Neumuenster (DE)

( * ) Notice: Subject to any disclaimer, the term of this patent is extended or adjusted under 35 U.S.C. 154(b) by 107 days.

(21) Appl. No.: 15/268,643

(22) Filed: Sep. 19, 2016

(65) Prior Publication Data

US 2017/0080479 A1 Mar. 23, 2017

(30) Foreign Application Priority Data

Sep. 21, 2015 (DE) ..... 10 2015 115 858

(51) Int. Cl.

| | |
|---|---|
| ***B21J 15/26*** | (2006.01) |
| ***B21J 15/28*** | (2006.01) |
| ***B25B 27/00*** | (2006.01) |
| ***B21J 15/10*** | (2006.01) |
| ***B21J 15/04*** | (2006.01) |

(52) U.S. Cl.

CPC ..... *B21J 15/28* (2013.01); *B21J 15/043* (2013.01); *B21J 15/105* (2013.01); *B21J 15/26* (2013.01); *B21J 15/285* (2013.01); *B25B 27/0014* (2013.01); *Y10T 29/49764* (2015.01); *Y10T 29/49766* (2015.01); *Y10T 29/49771* (2015.01)

(58) Field of Classification Search

CPC . B21J 15/28; B21J 15/285; B21J 15/26; B21J 15/043; B21J 15/105; B25B 27/0014; Y10T 29/49764; Y10T 29/49766; Y10T 29/49771

USPC ..... 29/407.01, 407.02, 407.09

See application file for complete search history.

(56) References Cited

U.S. PATENT DOCUMENTS

| | | | | |
|---|---|---|---|---|
| 5,605,070 | A | 2/1997 | Wille | |
| 8,805,575 | B1 | 8/2014 | Bloch et al. | |
| 9,079,240 | B2 * | 7/2015 | Schiffler | B21J 15/043 |
| 9,682,419 | B2 * | 6/2017 | Schmidt | B21J 15/043 |

(Continued)

FOREIGN PATENT DOCUMENTS

| | | | |
|---|---|---|---|
| CN | 100425399 | C | 10/2008 |
| CN | 104308790 | A | 1/2015 |

(Continued)

*Primary Examiner* — Bayan Salone

(74) *Attorney, Agent, or Firm* — Norman B. Thot

(57) ABSTRACT

A method for configuring a hand-held riveting tool operated by an electric drive to set a blind rivet element in a setting operation. The hand-held riveting tool includes a mandrel configured to perform an axial movement so as to perform the setting operation of the blind rivet element, and a control unit which monitors the axial movement of the mandrel. The mandrel includes a front end position to which the blind rivet element is fitted in a form-locked manner and/or a force-locked manner. The method includes axially moving the mandrel from the front end position into a rear end position which is assumed at a beginning of the setting operation, and automatically adjusting the rear end position of the mandrel based on a parameter provided to the control unit.

13 Claims, 2 Drawing Sheets

(56) References Cited

U.S. PATENT DOCUMENTS

| | | | | |
|---|---|---|---|---|
| 2004/0226159 | A1* | 11/2004 | Harlow | B21J 15/285 29/525.01 |
| 2010/0257720 | A1* | 10/2010 | Schiffler | B21J 15/043 29/525.06 |
| 2013/0138606 | A1* | 5/2013 | Kahle | G06F 17/30129 707/609 |
| 2013/0180098 | A1* | 7/2013 | Schmidt | B21J 15/043 29/525.06 |
| 2015/0196951 | A1 | 7/2015 | Bigot et al. | |
| 2016/0114383 | A1* | 4/2016 | Honsel | B25B 27/0014 29/525.07 |

FOREIGN PATENT DOCUMENTS

| | | | | |
|---|---|---|---|---|
| CN | 104776101 | A | 7/2015 | |
| DE | 44 06 946 | A1 | 9/1995 | |
| DE | 10 2010 035 613 | A1 | 3/2012 | |
| DE | 10 2013 105 703 | A1 | 12/2014 | |
| DE | 102013105703 | B4 * | 5/2015 | B25B 27/0014 |

* cited by examiner

METHOD FOR CONFIGURING A MANDREL OF A RIVETING TOOL FOR BLIND RIVET ELEMENTS AND RIVETING TOOL

CROSS REFERENCE TO PRIOR APPLICATIONS

Priority is claimed to German Patent Application No. DE 10 2015 115 858.2, filed Sep. 21, 2015. The entire disclosure of said application is incorporated by reference herein.

FIELD

The present invention relates to a method for configuring a hand-held riveting tool operated by an electric drive for setting blind rivet elements, wherein the riveting tool comprises a mandrel which is axially movable for performing the operation of setting a blind rivet element, wherein, in a front end position of the mandrel, the blind rivet element is fitted, in particular screwed, to the mandrel in a form-locked and/or a force-locked manner, and wherein the axial position of the mandrel is monitored by a control unit.

BACKGROUND

The setting of blind rivet elements and the special riveting tools to be employed for this purpose are described, for example, in DE 10 2013 105 703 A1. In order to set the blind rivet element, the blind rivet element is inserted into a riveting tool so that, using the mandrel to which the rivet element is screwed, the rivet element is subjected in a pulling movement to an axially attacking force. The rivet element is forcibly plastically deformed via the axial force to accomplish a form-locked connection of the rivet element with the workpiece. An interaction is required between the axial movement of the mandrel and the rivet element connected thereto, and a mouthpiece in order to achieve the deformation of the rivet element. The mouthpiece is arranged relative to the mandrel so that the movement of the rivet element is one-sidedly restricted by the mouthpiece and the rivet element is forced into a plastic deformation by driving the mandrel further in.

As part of this process, the blind rivet element is initially screwed onto the mandrel when the mandrel is in a front end position. The mandrel is then shifted by an axial movement into the rear end position in which the blind rivet element is in contact with the mouthpiece.

In order to find the most suitable set-up for the optimal setting and the shortest time cycle of a rivet element, it has to date been necessary to adjust the position of the mouthpiece relative to the mandrel in the rear end position to match the length of the type of rivet element used by screwing and unscrewing the mouthpiece. In order to correctly configure the riveting tool, it has therefore been necessary to perform the following working steps:

- fitting a suitable mandrel and a mouthpiece onto the riveting tool;
- screwing a blind rivet element onto the mandrel to an extent where the thread reaches its full bearing power;
- adjusting the mouthpiece so that it makes contact with the head of the blind rivet element; and
- setting the blind rivet element into the workpiece and then undoing the screw connection of the rivet element.

A correct configuration of the setting tool, in particular a correct adjustment of the mouthpiece relative to the mandrel in the rear end position and in dependence of the type of blind rivet element used, is important to correctly set the rivet element. An incorrect set-up may lead to the rivet element not being fixed in its position with optimum stability. If the thread of the rivet element is not screwed far enough into the mouthpiece, or in other words, if the thread of the rivet element contacts the mouthpiece before the thread has reached its full bearing power, the thread of the rivet element may be damaged or be torn out. Valuable time is lost in the working cycle if the mandrel is screwed in too far. Both these factors must be avoided.

Setting tools according to the prior art only consider these facts to the extent that they rely on the "finger-tip" skill of the user. The quality of the setting job is therefore essentially dependent on the skill of the user. Adjustment of the mouthpiece, especially when using several different types of blind rivet element, is also a job which requires a considerable amount of time.

SUMMARY

An aspect of the present invention is to further develop a riveting tool for setting blind rivet elements which overcome the aforementioned disadvantages. An aspect of the present invention is in particular to provide a method to configure a riveting tool which provides for automatically adjusting the relative position between the blind rivet element and the mouthpiece in the rear end position of the mandrel, as is necessary to configure a riveting tool to perform a setting operation. An aspect of the present invention is additionally that this set-up automatically adapts itself to different types of blind rivet elements.

In an embodiment, the present invention provides a method for configuring a hand-held riveting tool operated by an electric drive to set a blind rivet element in a setting operation. The hand-held riveting tool includes a mandrel configured to perform an axial movement so as to perform the setting operation of the blind rivet element, and a control unit configured to monitor the axial movement of the mandrel. The mandrel comprises a front end position to which the blind rivet element is fitted in at least one of a form-locked manner and a force-locked manner. The method includes axially moving the mandrel from the front end position into a rear end position which is assumed at a beginning of the setting operation, and automatically adjusting the rear end position of the mandrel based on a parameter provided to the control unit.

BRIEF DESCRIPTION OF THE DRAWINGS

The present invention is described in greater detail below on the basis of embodiments and of the drawings in which.

DETAILED DESCRIPTION

Figure 1:
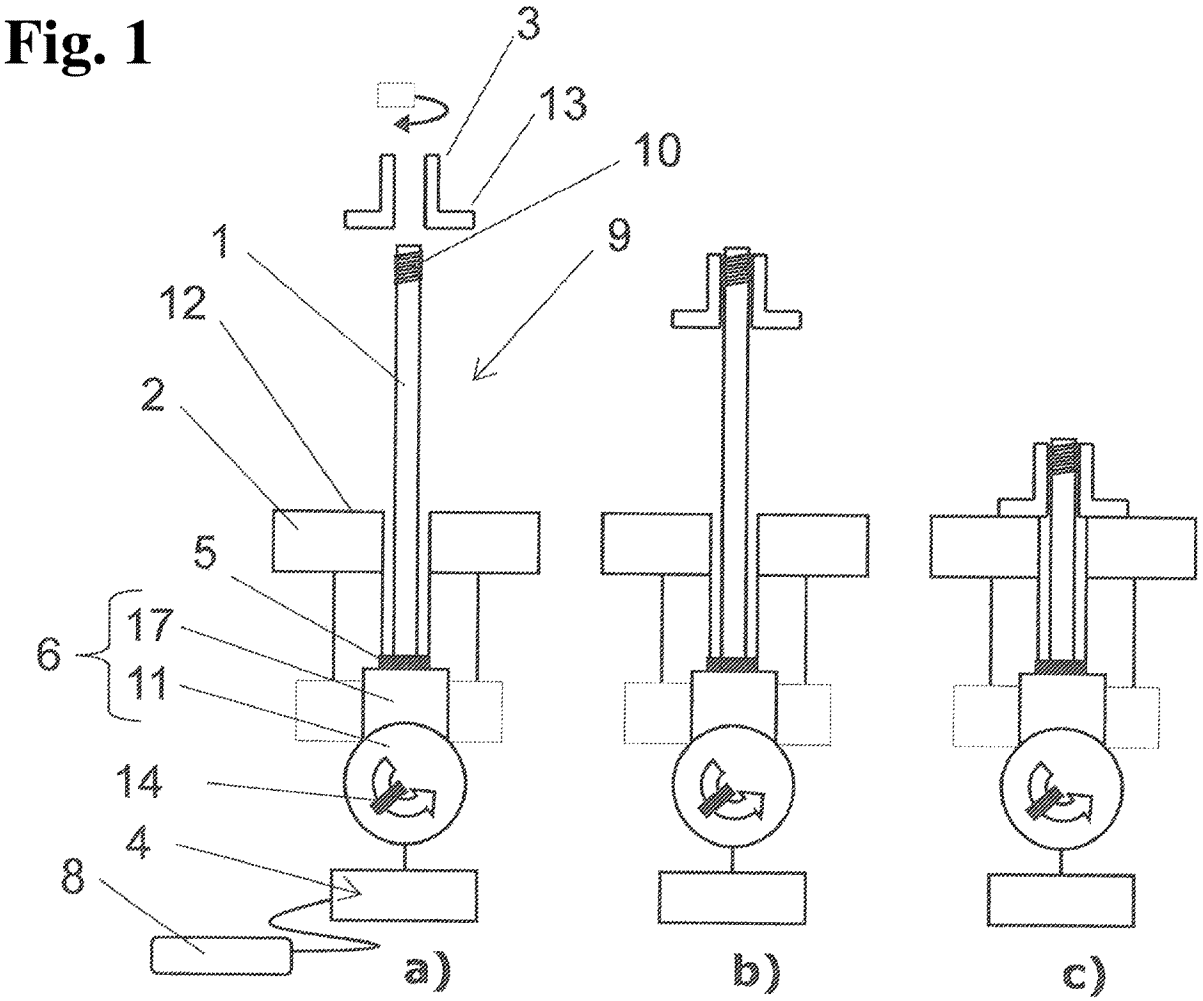
FIG. 1 shows an arrangement with a riveting tool while performing the method with: a) a mandrel in the front end position prior to fitting a blind rivet element, b) the mandrel in the front end position with a fitted blind rivet element, and c) the mandrel in the rear end position.

In an embodiment, the present invention provides that the control unit inside the riveting tool automatically adjusts a rear end position, i.e., the starting position at the beginning of the riveting operation, via a specified parameter. The parameter may be set by a single manual input. The parameter may alternatively result from an electronic read-out of the parameter itself, or from reading the variables required for calculating the paramater out of a data store. In an embodiment of the present invention, the parameter is the result of a measurement which is carried out inside the riveting tool.

As part of the method, the mandrel is axially moved out of its front end position into the rear end position to be assumed at the beginning of the setting operation, wherein the rear end position of the mandrel is automatically adjusted in accordance with the parameter specified to the control unit.

A special feature of the present invention in particular includes the relative position between the mandrel supporting the blind rivet element and the mouthpiece automatically being adjusted by the riveting tool/its control unit, and taking into account the particular type of blind rivet element used. Because the setting operation takes place automatically without the direct involvement of the user, in particular without his/her experience and fingertip skill, the optimal adjustment result is achieved and user-independent repeatability is provided at all times. The factors of erroneous, impaired-quality or just differing results are thereby eliminated.

In an embodiment of the present invention, the parameter can, for example, result from an input which the user enters manually, for example, via a contact-sensitive display on the riveting tool. The rear end position of the mandrel itself is considered as an input value. In this embodiment, the user can manually adjust the feed path which must be overcome by the mandrel between the front end position and the rear end position. Starting variables can alternatively be entered from which the parameter is calculated. These are, for example, organizational details of the manufacturer or constructional parameters such as the length of the blind rivet element. The position of the rear end position can then be determined based on these starting variables.

In an embodiment of the present invention, the input can, for example, be read-in by a digital identification mark in the form of a tag. A tag is a label which can be read-out with a technical device and which contains information on the nature, such as the type, of riveting element. Tags may be provided as electronically or optically readable labels. An electronic tag may be configured as an NFC-tag or as an RFID-tag, while an optical tag may be a QR-code or a barcode.

To read out the tag, the riveting tool can, for example, comprise a reader which reads the information on the tag. The reader may be directly connected to the control unit to communicate the read-out data to the control unit. The connection for communicating the data may take the form of a wireless connection via a radio connection or it may be a cable. The reader may in particular be separated from the riveting tool or it may be integrated therewith.

In an embodiment of the present invention, the tag can, for example, be fixed to the blind rivet element itself. The user can then bring the riveting tool with the tag fixed thereto into the read range of a reader. The reader passes the read-out data, in particular the parameter itself, to the control unit, and from this data the control unit determines the rear end position of the mandrel specifically for the riveting element used. The tag may alternatively be fixed to the container in which the blind rivet elements are stored and/or in which the blind rivet elements are supplied.

In an embodiment of the present invention, an association can, for example, be stored in the control unit, for example as a calculation rule between the organizational details of the manufacturer and the rear end position of the mandrel. The control unit can calculate the value for the rear end position via the association. This value is specific to the type of riveting element used.

In an embodiment of the present invention, the parameter to be specified can, for example, result from a variable which is measured via the riveting tool. The measured variable used can, for example, be the force which is applied to the mandrel to perform the axial movement. A possible variable to determine the force could be to measure the current which the riveting tool draws when in operation. A signal from a measuring instrument existing inside the riveting tool could alternatively be utilized which measures the force applied to the mandrel to perform the axial movement.

In an embodiment of the present invention, the rear end position of the mandrel can, for example, be determined when a critical value stored as a parameter for the measured variable is exceeded. The critical value specified could be a maximum value for the power drawn. In operation, when the blind rivet element seated on the mandrel abuts against the mouthpiece, an abrupt rise in force and thus in the current drawn occurs which exceeds the specified critical value. This allows the rear end position of the mandrel to be defined.

In an embodiment of the present invention, the critical value for the measured variable can, for example, be stored in the control unit. The control unit stops the axial movement of the mandrel as soon as it detects that the critical value has been reached. The mandrel thus remains in the rear end position.

In an embodiment of the present invention, the riveting tool can, for example, have a drive with an electric motor and a measuring device to determine the rotational angle position of the motor. If the transmission mechanism is known, it is possible to draw conclusions from the rotational angle position of the motor as to the position of the mandrel. The position of the mandrel can be determined by monitoring the rotational movement. The drive can, for example, be a brushless servomotor which can assume any given rotational angle position and whose rotational angle position is always known.

The present invention will be explained in detail below under reference to the drawings.

FIG. 1, in a simplified view, shows a schematic cross-section of a riveting tool 9 having the features of the present invention. The riveting tool 9 is used to set blind rivet elements 3, as will now be described with reference to FIG. 2.

The riveting tool 9 has a cylindrically formed mandrel 1 with a front axial end 10. The front axial end 10 of the mandrel 1 is outside the riveting tool 9. A thread is provided at the front axial end 10 onto which a blind rivet element 3 has been screwed. The tool-side of the mandrel 1 is arranged in the riveting tool 9 so that the mouth forms a mouthpiece 2. The mandrel 1 and the mouthpiece 2 are coaxially arranged in relation to each other, wherein the mandrel 1 extends through the mouthpiece 2 into the riveting tool 9. Inside the riveting tool 9, the mandrel 1 is in operative connection with an electric drive 6 and is axially movable. Due to the coaxial arrangement of the mandrel 1 and the mouthpiece 2, a relative movement is created between mandrel 1 and mouthpiece 2 which causes the mandrel 1 to be axially withdrawn from the mouthpiece 2 and to also to be drawn into the mouthpiece 2. The axial movement of the mandrel 1 caused by the electric drive 6 is controlled by a control unit 4. The relative directional details referring to an axis, such as axial and coaxial, refer to the longitudinal axis of the mandrel.

The method according to the present invention for configuring a riveting tool will now be discussed in detail with reference to the FIG. 1 *a*) to *c*).

The riveting tool 9 is schematically shown in its inactive position in FIG. 1 *a*) and *b*). The specified position of the mandrel 1 is the front end position in the inactive position. In the front end position, the front axial end 10 of the mandrel 1 has a maximum distance to a stop surface 12 of the mouthpiece 2 which can be reached by an axial relative movement between the mandrel 1 and the mouthpiece 2. The position which is taken up by the mandrel 1 in the inactive position of the riveting tool 9 is stored in the control unit 4 as a parameter. The electric drive 6 comprises a motor 11 which generates a rotational movement, and a gear 17 for converting the rotational movement into an axial movement.

In a first step, the blind rivet element 3 is attached to the front axial end 10 of the mandrel 1, wherein the attachment is effected by screwing the blind rivet element 3 onto the thread. The blind rivet element 3 is screwed onto the mandrel 1 using a number of turns, for example, at least five turns.

In an embodiment of the method of the present invention, an input is made in a second step which specifies the rear end position of the mandrel 1 as being the position which the mandrel 1 is to take up prior to starting the setting operation. In the rear end position, the blind rivet element 3 attached to the front axial end 10 of the mandrel 1 has performed, via the mandrel 1, a movement in the direction of the mouthpiece 2 up to the point where a blind rivet element head 13 of the blind rivet element 3 touches a stop surface 12 of the mouthpiece 2. The blind rivet element head 13 can, for example, come to a stop as it makes contact with the stop surface 12.

The input, via which the position which the mandrel 1 is to take up is specified, is provided via an input device, for example via keys or via a reader 8. The reader 8 may be used to read-in an RFID tag or a barcode. The input comprises information from which the position which the mandrel 1 is to take up at the beginning of the setting operation can be determined. The input can, for example, include the rear end position, organizational details of the manufacturer as to the type of blind rivet element 3 used, and/or constructional parameters of the type of a blind rivet element 3 used. The association of organizational details of the manufacturer and/or constructional parameters of the blind rivet elements 3 with the position to be taken up by the mandrel 1 at the beginning of the setting operation, is stored in the control unit 4.

Determination of the current axial position of the mandrel 1 relative to the mouthpiece 2 is effected by the control unit 4 via a suitable position measuring device 14. The position measuring device 14 can, for example, measure the angle of rotation and/or the number of revolutions of the motor 11. The motor 11 can, for example, be provided as a brushless servomotor where the position measuring device 14 "knows" its rotational position.

In an embodiment of the method of the present invention, the mandrel 1, in the third step, performs together with the blind rivet element 3 an axial movement into the rear end position, which must be taken up by the mandrel 1 at the beginning of the setting operation (FIG. 1*c*)).

In an embodiment of the method of the present invention, the mandrel 1 together with the screwed-on blind rivet element 3 initially performs an axial movement in the direction of the mouthpiece 2. The axial movement starts at a first point in time, while the blind rivet element 3 touches the mouthpiece 2 at a second point in time after the axial movement (FIG. 1*c*)). This means that the axial movement is braked, wherein the force, which is applied to the mandrel 1, abruptly rises.

The force and/or the measured variable which relates to the force is measured by a suitable force-measurement device 5. Measured variables which relate to the force can, for example, be the current drawn by the motor 11 or the torque acting upon the electric drive 6. A force-measurement device 5 may therefore be a current measurement device.

If the force measured by the force-measurement device 5 and/or the measured variable relating to the force exceeds a specified critical value, the axial movement of the mandrel 1 can then, for example, be stopped in a third step. The critical measured value when stopping the axial movement of the mandrel 1 is stored in the control unit 4. The mandrel 1 is in the rear end position and is ready for the setting operation when axial movement stops (FIG. 1*c*)).

Figure 2:
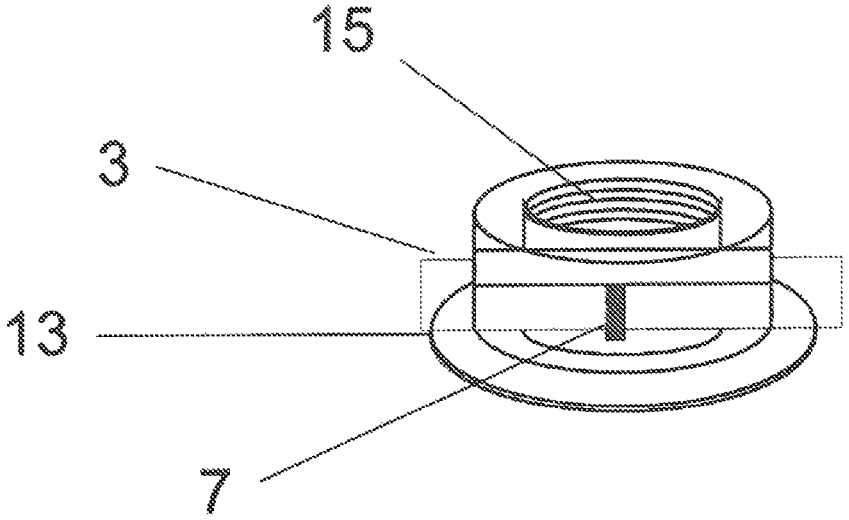
FIG. 2 shows the blind rivet element of FIG. 1 in a perspective view with a tag.

FIG. 2 shows a blind rivet element 3 in a simplified perspective view. The blind rivet element 3 comprises an internal thread 15 with which it can be screwed onto the mandrel 1. The blind rivet element head 13 can, for example, comprise a flat support surface on that side which faces the mouthpiece 2 during the setting operation. The blind rivet element 3 further comprises a tag 7 to be read out by the reader 8 (FIG. 1).

Figure 3:
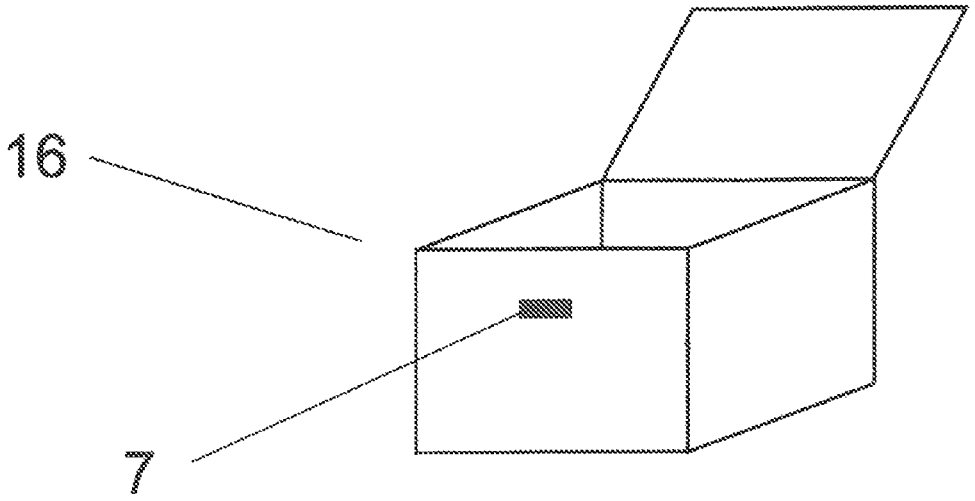
FIG. 3 shows a packaging for the blind rivet element of FIG. 2 in a perspective view with a tag.

FIG. 3 shows a container 16 for blind rivet elements 3 in a simplified perspective view. A tag 7 to be read out by the reader 8 is attached to the container 16.

The present invention is not limited to embodiments described herein; reference should be had to the appended claims.

What is claimed is:

1. A method for configuring a hand-held riveting tool operated by an electric drive for setting a blind rivet element in a setting operation, the hand-held riveting tool comprising:

a mandrel configured to perform an axial movement so as to perform the setting operation of the blind rivet element, the mandrel comprising a front end position to which the blind rivet element is fitted in at least one of a form-locked manner and a force-locked manner; and a control unit configured to monitor the axial movement of the mandrel, the method comprising:

axially moving the mandrel from the front end position into a rear end position, the rear end position being defined at a beginning of the setting operation; and automatically adjusting the rear end position of the mandrel with respect to the mouthpiece based on a parameter related to the blind rivet element provided to the control unit.

2. The method as recited in claim 1, wherein the blind rivet element is fitted to the front end position of the mandrel by screwing.

3. The method as recited in claim 1, wherein the parameter is based on an input provided by a user.

4. The method as recited in claim 3, wherein the input specified by the user comprises at least one of organizational details of the manufacturer, constructional variables of the blind rivet element, and the rear end position of the mandrel.

5. The method as recited in claim 4, wherein the control unit is configured to store associations of the organizational details of the manufacturer, the constructional variables of the blind rivet elements, and the rear end position of the mandrel.

6. The method as recited in claim 4, wherein the constructional variables of the blind rivet element include a blind rivet element length.

7. The method as recited in claim 1, wherein, a tag is attached to at least one of the blind rivet element and to a container containing the blind rivet element, the tag being configured to store information from which the parameter can be provided, and the method further comprises:

reading out the tag by the user via a reader so as to provide the parameter based on the information stored in the tag.

8. The method as recited in claim 7, wherein the tag is a NFC-tag or a barcode.

9. The method as recited in claim 1, wherein the parameter is based on a measured variable relating to a force axially moving the mandrel, the force being measured by the hand-held riveting tool.

10. The method as recited in claim 9, wherein, a critical value for the measured variable is stored in the control unit, and the rear end position of the mandrel results from reaching the critical value.

11. A hand-held riveting tool for setting a blind rivet element configured to perform the method as recited in claim 1, the hand-held riveting tool comprising;

a drive comprising an electric motor;

a mandrel configured to perform an axial movement so as to perform a setting operation of the blind rivet element;

a control unit configured to monitor the axial movement of the mandrel; and a device configured to automatically determine a rear end position of the mandrel and to automatically adjust itself based on a parameter provided to the control unit.

12. The riveting tool as recited in claim 11, wherein the device is further configured to record a measured variable which relates to a force acting upon the mandrel.

13. The riveting tool as recited in claim 11, further comprising:

a device configured to determine a rotational angle position of the electric motor.

* * * * *